US009711093B2

(12) United States Patent
Fujiwara et al.

(10) Patent No.: US 9,711,093 B2
(45) Date of Patent: Jul. 18, 2017

(54) LIGHT EMITTING DEVICE FOR IMAGE DISPLAY, AND IMAGE DISPLAY DEVICE

(75) Inventors: Kohji Fujiwara, Osaka (JP); Takayuki Murai, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 502 days.

(21) Appl. No.: 13/522,115

(22) PCT Filed: Nov. 10, 2010

(86) PCT No.: PCT/JP2010/069987

§ 371 (c)(1),
(2), (4) Date: Jul. 13, 2012

(87) PCT Pub. No.: WO2011/104948

PCT Pub. Date: Sep. 1, 2011

(65) Prior Publication Data

US 2012/0299891 A1 Nov. 29, 2012

(30) Foreign Application Priority Data

Feb. 24, 2010 (JP) ..... 2010-038464

(51) Int. Cl.
*G09G 3/288* (2013.01)
*G09G 3/34* (2006.01)

(52) U.S. Cl.
CPC ..... *G09G 3/3426* (2013.01); *G09G 2320/041* (2013.01); *G09G 2330/021* (2013.01); *G09G 2360/144* (2013.01); *G09G 2360/16* (2013.01)

(58) Field of Classification Search
CPC .. G09G 2320/041; G09G 3/3406; G09G 5/02; G09G 2320/0233

(Continued)

(56) References Cited

U.S. PATENT DOCUMENTS 6,753,842 B1 6/2004 Williams et al.
2005/0184952 A1 8/2005 Konno et al.

(Continued)

FOREIGN PATENT DOCUMENTS

JP 2005-258403 A 9/2005
JP 2007-034251 A 2/2007

(Continued)

OTHER PUBLICATIONS

Wikipedia, Pulse-width modulation, Feb. 9, 2010 (http://en.wikipedia.org/w/index.php?title=Pulse-width_modulation&oldid=342854930).*

(Continued)

*Primary Examiner* — Lin Li
(74) *Attorney, Agent, or Firm* — Keating & Bennett, LLP

(57) ABSTRACT

The light emitting device is divided into a plurality of areas, and has, as main configuration elements, an area drive circuit (2), which generates LED data and LCD data, an LED controller (4), and a backlight unit (5), which is provided with a plurality of LEDs (52) corresponding to each of the areas. The power calculating unit of the LED controller (4) is mainly configured of a power calculating circuit (42), a power limiter circuit (43), and a limit value updating circuit (45), and the emission power to be supplied to each of the LEDs (52) is calculated for each are on the basis of image data. The power calculating unit performs the calculation such that the sum (Psum) of the emission power does not exceed a power limit value (Plimit) currently set, and updates the power limit value (Plimit) by following a previously set pattern.

10 Claims, 8 Drawing Sheets

(58) Field of Classification Search
USPC ..... 257/88; 307/37; 315/291, 297; 340/539.12; 345/77, 87, 94, 102, 173, 345/204, 207, 589, 690, 691; 348/687; 349/61; 455/566; 709/219
See application file for complete search history.

(56) References Cited

U.S. PATENT DOCUMENTS

| | | | | |
|---|---|---|---|---|
| 2006/0001642 | A1* | 1/2006 | Hong et al. | 345/102 |
| 2006/0214904 | A1 | 9/2006 | Kimura et al. | |
| 2006/0221047 | A1* | 10/2006 | Tanizoe et al. | 345/102 |
| 2008/0218493 | A1* | 9/2008 | Patten et al. | 345/173 |
| 2009/0122087 | A1 | 5/2009 | Maruyama et al. | |
| 2010/0120471 | A1* | 5/2010 | Uchikawa et al. | 455/566 |
| 2010/0225574 | A1 | 9/2010 | Fujiwara et al. | |
| 2010/0321581 | A1* | 12/2010 | Iwakura et al. | 348/687 |

FOREIGN PATENT DOCUMENTS

| | | | | |
|---|---|---|---|---|
| JP | 2009-237510 | A | | 10/2009 |
| KR | 2004063209 | A | * | 7/2004 |
| WO | 2009/096068 | A1 | | 8/2009 |

OTHER PUBLICATIONS

Official Communication issued in International Patent Application No. PCT/JP2010/069987, mailed on Jan. 18, 2011.

* cited by examiner

FIG.5

| | | | | | |
|---|---|---|---|---|---|
| 0 (1) | 50 (2) | 50 (3) | 50 (4) | 50 (5) | 0 (6) |
| 100 (7) | 100 (8) | 100 (9) | 100 (10) | 100 (11) | 100 (12) |
| 100 (13) | 100 (14) | 100 (15) | 100 (16) | 100 (17) | 100 (18) |
| 0 (19) | 50 (20) | 50 (21) | 50 (22) | 50 (23) | 0 (24) |

FIG.6

| | | | | | |
|---|---|---|---|---|---|
| 0 (1) | 37.5 (2) | 37.5 (3) | 37.5 (4) | 37.5 (5) | 0 (6) |
| 75 (7) | 75 (8) | 75 (9) | 75 (10) | 75 (11) | 75 (12) |
| 75 (13) | 75 (14) | 75 (15) | 75 (16) | 75 (17) | 75 (18) |
| 0 (19) | 37.5 (20) | 37.5 (21) | 37.5 (22) | 37.5 (23) | 0 (24) |

LIGHT EMITTING DEVICE FOR IMAGE DISPLAY, AND IMAGE DISPLAY DEVICE

TECHNICAL FIELD

The present invention relates to a light emitting device for image display that emits light for image display, and also relates to an image display device provided therewith.

BACKGROUND ART

There have conventionally been devised various types of image display devices such as liquid crystal display devices and PDP (plasma display panel) display devices. Generally, an image display device incorporates a light emitting device for image display that emits light used in image display. By controlling the degree of transmission, intensity, etc. of the light appropriately according to image data fed to it, the image display device displays images.

For example, a liquid crystal display device incorporates a backlight (corresponding to part of the light emitting device for image display mentioned above) and a liquid crystal panel, and the liquid crystal panel controls the degree of transmission of backlight in such a way as to display an image. As such backlights also, various types have been devised.

For example, in one conventionally devised backlight, a plate-form member that is arranged opposite a liquid crystal panel is divided into a plurality of areas (regions), and light emitting elements (such as LEDs) are provided in those areas respectively. For another example, Patent Document 1 listed below discloses a type (hereinafter referred to also as the "area-driven type" for convenience's sake) in which the light emission of light emitting elements provided in different areas respectively is controlled on an area-by-area basis.

Purportedly, with the image display device disclosed in Patent Document 1, it is possible to adjust the luminance of the backlight (in other words, the light emission electric power supplied to the light emitting elements of the backlight) on an area-by-area basis according to image data, and thus it is possible to obtain an image with a high contrast ratio.

LIST OF CITATIONS

Patent Literature

Patent Document 1: JP-A-2005-258403
Patent Document 2: JP-A-2007-34251

SUMMARY OF INVENTION

Technical Problem

As discussed above, applying a backlight of an area-driven type to an image display device enables it to display an image with a high contrast ratio. However, from the perspectives of power saving, heat reduction, etc., the electric power consumption of a backlight (generally considered to be approximately equal to the sum of light emission electric powers) is subject to a predetermined limit value.

Accordingly, the light emission electric power for each area has to be determined such that the electric power consumption of the backlight does not exceed the limit value. According to one method that takes this into consideration, for example, area-by-area ratios of light emission electric power are determined according to image data, and the light emission electric power for each area is controlled such that those ratios are maintained and in addition that the sum of light emission electric powers does not exceed the limit value.

How the electric power consumption of the backlight should actually be limited depends on the situation at the moment (for example, the use environment of the image display device). For example, in a case where an image display device is used in a cold place, the device is less likely to be hot than otherwise, and therefore, from the perspective of heat reduction, a comparatively loose limit on the electric power consumption of the backlight suffices.

Inconveniently, however, if the above-mentioned limit value is kept constant irrespective of the situation at the moment, to universally cope with every situation, it is necessary that the limit value be set to allow for the severest conditions (that is, to be the smallest possible). This excessively suppresses the electric power consumption of the backlight, and often makes it impossible to display a brighter image in a situation where it is possible to do so.

Also, from the perspective of power saving, to intentionally display a dimmer image, the limit value may be deliberately set smaller than it typically is. Out of these and other considerations, it is desirable that how to limit the electric power consumption can be flexibly changed to suit the situation. Although the above description takes up a backlight as an example of a light emitting device for image display, similar problems can be encountered in other cases as well (for example, with a device for use in a PDP display device).

In view of the problems mentioned above, the present invention aims to provide a light emitting device for image display that, despite being of an area-driven type, can limit the light emission electric power supplied to individual light emitting elements flexibly to suit the situation at the moment, and to provide an image display device incorporating such a light emitting device for image display.

Solution to Problem

To achieve the above object, according to one aspect of the invention, a light emitting device for image display, for incorporation in an image display device for display of an image based on image data, includes: a light emitting unit which is divided into a plurality of areas and which includes a plurality of light emitting elements corresponding to the areas respectively; and a power calculation section which calculates the light emission electric powers to be supplied to the light emitting elements respectively based on the image data on an area-by-area basis. The light emitting device emits light used in the display of the image by supplying the light emission electric powers to the light emitting elements respectively according to the result of the calculation. Here, the power calculation section performs the calculation such that a sum of the light emission electric powers does not exceed a currently set power limit value, and includes a limit value updating section which updates the power limit value according to a previously set pattern.

With this configuration, by previously setting a pattern according to which to determine how to update the power limit value to suit the situation (for example, a pattern such that the higher the temperature, the smaller the power limit value is updated to be), it is possible, even with an area-driven type, to limit the light emission electric power supplied to the individual light emitting elements flexibly to suit the situation at the moment.

In the above configuration, preferably, the limit value updating section includes a sensor which detects an environmental condition, and updates the power limit value according to the detection result of the sensor. With this configuration, it is possible to limit the light emission electric power supplied to the individual light emitting elements flexibly to suit the environment at the moment.

In the above configuration, more specifically, the sensor may be at least one of a temperature sensor which detects temperature, an illuminance sensor which detects illuminance, and a human presence sensor which detects human presence.

In the above configuration, preferably, the limit value updating section includes at least the illuminance sensor, and the pattern is set according to an instruction from a user on an alternative basis from a plurality of patterns including a pattern such that the higher the luminance detected by the illuminance sensor is, the greater the power limit value is made, and a pattern such that the higher the luminance detected by the illuminance sensor is, the smaller the power limit value is made.

With this configuration, it is possible to limit the light emission electric power supplied to the individual light emitting elements flexibly to suit the illuminance at the moment. Moreover, the user can, by feeding an instruction as to which pattern to set, determine how the illuminance should be reflected in the power limit value.

In the above configuration, preferably, the limit value updating section includes at least the temperature sensor, and updates the power limit value such that the higher the temperature detected by the temperature sensor is, the smaller the power limit value is made.

With this configuration, it is possible to limit the light emission electric power supplied to the individual light emitting elements flexibly to suit the temperature at the moment. Moreover, with this configuration, it is possible to update the power limit value on the principle that, when the device is likely to become hot, priority is given to suppressing a rise in device temperature and otherwise priority is given to image viewability.

In the above configuration, preferably, the limit value updating section includes at least the human presence sensor, and the pattern is set according to an instruction from a user on an alternative basis from a plurality of patterns including a pattern such that when the human presence sensor detects human presence, the power limit value is made greater than when the human presence sensor does not detect human presence, and a pattern such that when the human presence sensor detects human presence, the power limit value is made smaller than when the human presence sensor does not detect human presence.

With this configuration, it is possible to limit the light emission electric power supplied to the individual light emitting elements flexibly to suit human presence or absence at the moment. Moreover, the user can, by feeding an instruction as to which pattern to set, determine how human presence or absence should be reflected in the power limit value.

In the above configuration, preferably, the limit value updating section updates the power limit value according to whether the current time belongs to a previously set time zone or not.

With this configuration, it is possible to limit the light emission electric power supplied to the individual light emitting elements flexibly to suit the time zone at the moment. Even in a case where none of various sensors for detecting environmental conditions is provided, it is possible to limit the light emission electric power flexibly to suit the situation at the moment.

In the above configuration, preferably, the limit value updating section updates the power limit value according to the value of the APL of the image data. With this configuration, it is possible to limit the light emission electric power supplied to the individual light emitting elements flexibly to suit the APL of the image data at the moment (the image being displayed on the image display device).

In the above configuration, preferably, the power calculation section performs the calculation such that the peak luminance of the light emitting elements is limited at or below a currently set peak luminance limit value, and the limit value updating section updates the peak luminance limit value according to a previously set pattern.

With this configuration, by previously setting a pattern according to which to determine how to update the peak luminance limit value to suit the situation (for example, a pattern such that when the APL of the image data is smaller than a predetermined threshold value, the peak luminance limit value is updated to be a predetermined value), it is possible to update also the peak luminance of the light emitting elements (the maximum value of their luminance) flexibly to suit the situation at the moment.

In the above configuration, preferably, the limit value updating section updates the peak luminance limit value according to the value of the APL of the image data.

In the above configuration, preferably, the power calculation section determines, based on the image data, the ratios of the light emission electric powers to be supplied for the areas respectively, and performs the calculation such that the sum of the light emission electric powers does not exceed the power limit value and in addition according to the determined ratios.

With this configuration, it is possible, while limiting the light emission electric power supplied to the individual light emitting elements at or below the currently set power limit value, to display an image with a high contrast ratio on the image display device.

In the above configuration, more specifically, the light emitting elements may be LEDs. According to another aspect of the invention, an image display device is so configured as to display an image by using light emitted from a light emitting device for image display configured as described above.

More specifically, the above image display device preferably includes: a backlight; and an LCD panel of which the degree of light transmission is adjusted on a pixel-by-pixel basis based on the image data. The image display device displays an image in the display region of the LCD panel by supplying light from the backlight to the LCD panel. Here, the backlight is a light emitting device for image display configured as described above. With this image display device, it is possible to obtain the benefits of an light emitting device for image display configured as described above.

Advantageous Effects of the Invention

As discussed above, with a light emitting device for image display according to the invention, by previously setting a pattern according to which to determine how to update the power limit value to suit the situation, it is possible, even with an area-driven type, to limit the light emission electric power supplied to the individual light emitting elements flexibly to suit the situation at the moment. With an image display device according to the invention, it is possible to obtain the benefits of an light emitting device for image display according to the invention.

BRIEF DESCRIPTION OF DRAWINGS

FIG. 5 is a diagram illustrating PWM values corresponding to areas;

FIG. 6 is a diagram illustrating corrected PWM values corresponding to areas;

DESCRIPTION OF EMBODIMENTS

Image display devices (liquid crystal display devices) embodying the present invention will be described below by way of a first to a third embodiment. As will be clarified later, the embodiments differ mainly in the manner in which the electric power supplied to a backlight is determined.

(1) First Embodiment

[Configuration and Other Features of Image Display Device]

Figure 1:
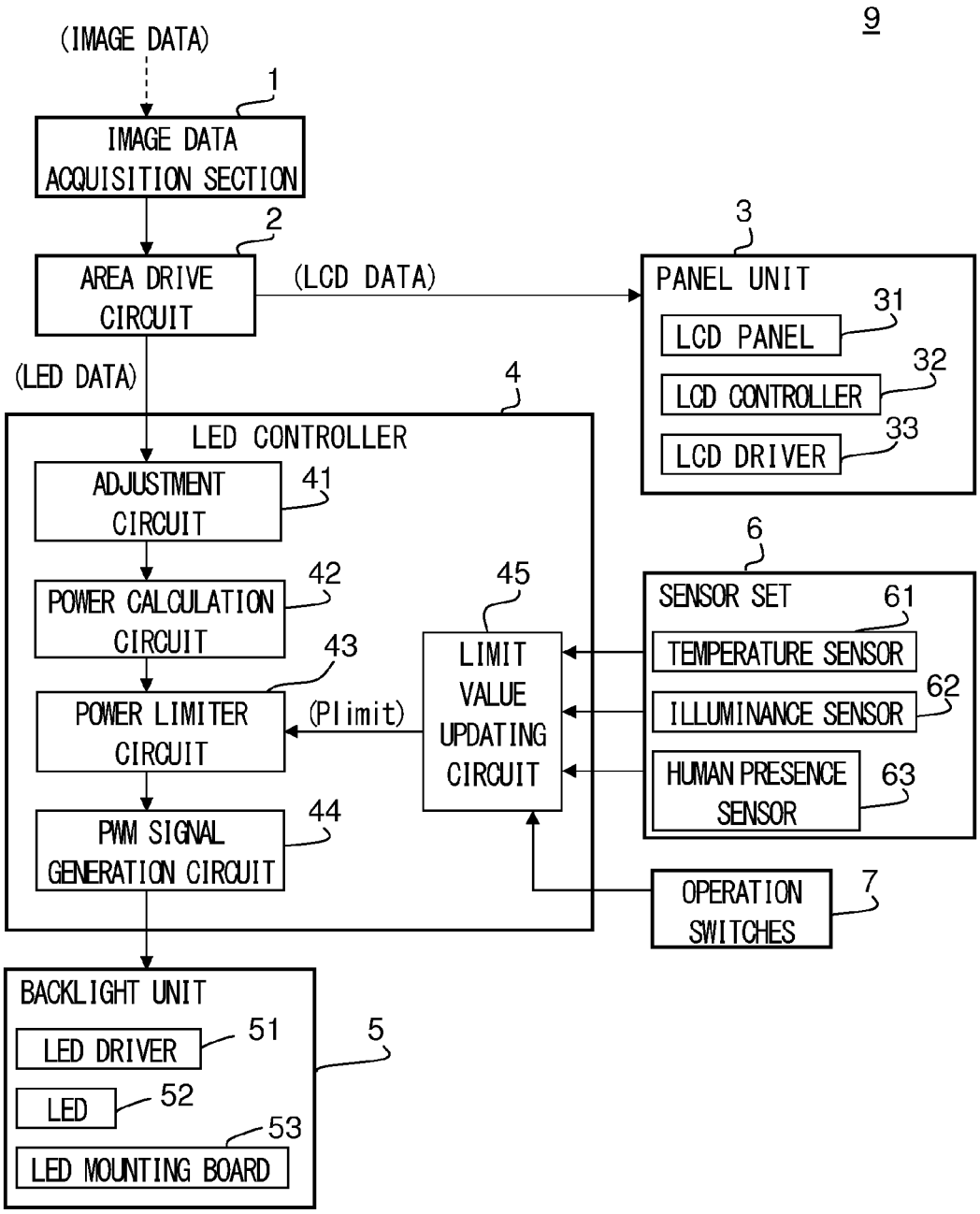
FIG. 1 is a configuration diagram of an image display device according to a first embodiment of the invention.

First, a first embodiment of the invention will be described. FIG. 1 is a configuration diagram of an image display device according to the first embodiment. As shown there, the image display device 9 includes an image data acquisition section 1, an area drive circuit 2, a panel unit 3, an LED controller 4, a backlight unit 5, a sensor set 6, operation switches 7, etc.

The image data acquisition section 1 acquires, from outside, image data for displaying an image, and feeds it to the area drive circuit 2. For example, in a case where the image display device 9 is a television receiver, the image data acquisition section 1 includes an antenna, a tuner, etc., and acquires image data (a video signal) by receiving television broadcast. The image data is data that specifies luminance etc. at each pixel on a frame-by-frame basis and hence data that represents the content of a moving image (or still image).

The area drive circuit 2 receives the image data from the image data acquisition section 1 and, based on the image data, generates data (hereinafter referred to as "LED data") indicating the light emission electric power of LEDs. The LED data is generated such that the higher the luminance in the image data, the higher the light emission electric power it indicates.

The LED data is, for example, in a format of a 12-bit digital signal, and is fed to the LED controller 4. In the embodiment under discussion, the light emission of each LED is controlled by a PWM (pulse-width modulation) signal, and accordingly the LED data is expressed in the form of the PWM values (duty factors) of PWM signals.

Based on the image data, the area drive circuit 2 also generates LCD data, which is data of the light transmittance at each pixel of an LCD panel 11. The generated LCD data is fed to the panel unit 3.

The panel unit 3 is a unit that functions as a panel that displays an image, and includes, in addition to the LCD panel 31, an LCD controller 32, an LCD driver 33, etc. The LCD panel 31 has a rectangular shape as seen in a plan view, and is composed of a pair of glass substrates bonded together with a predetermined gap in between, with liquid crystal sealed between the two glass substrates.

On one of the glass substrates, there are provided switching elements (for example, thin-film transistors) connected to mutually crossing source conductors and gate conductors, pixel electrodes connected to those switching elements, an alignment film, etc. On the other glass substrate, there are provided color filters composed of differently colored, such as R, G, and B (red, green, and blue), segments arranged in a predetermined array, a common electrode, an alignment film, etc.

Further outside the two substrates, polarizer plates are arranged. In the embodiment under discussion, it is assumed that the LCD panel 31 has 1920×1080-dot color pixels for Hi-Vision formed in its display region. The number and type of pixels may be any other than just mentioned.

Figure 2:
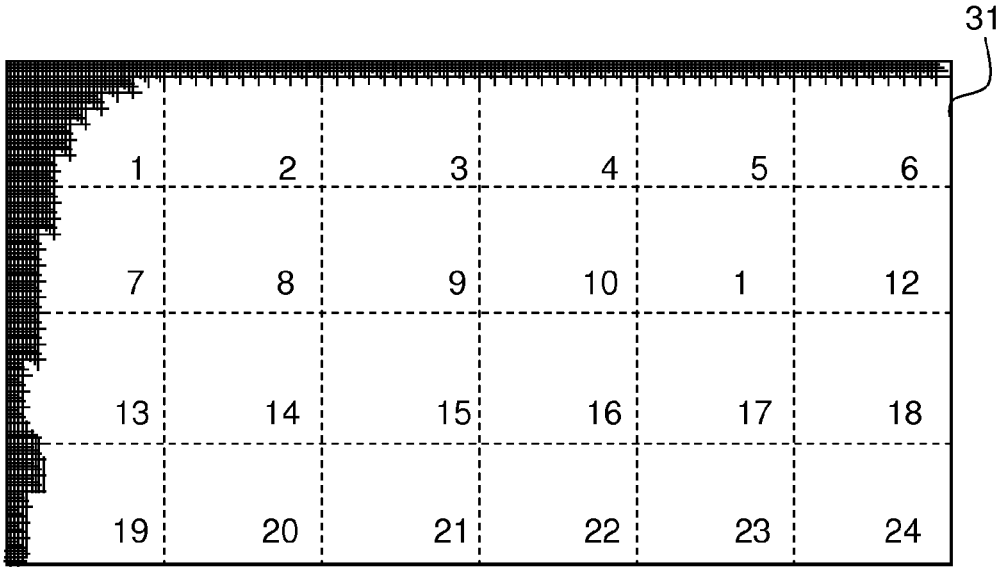
FIG. 2 is a diagram illustrating parts set on an LCD panel.

As shown in FIG. 2, the display region of the LCD panel 31 is divided into 24 (=6×4) equal parts (1st to 24th parts). In FIG. 2, a number n (where n is an integer of 1 to 24) indicates that the part in which it is marked is the n-th part. For example, the first part is a portion of the display region in its upper left corner where 320 (=1920/6)×20 (=1080/4)-dot pixels belong.

Here, it is only for convenience's sake that the term "part" is used to refer to a portion of the display region. Although there are 24 of the parts in the embodiment under discussion, this is merely one example; there may be more or less of the parts. As will be described in more detail later, an LED mounting board 53 arranged behind the LCD panel 31 is divided into 24 areas (with at least one LED mounted in each area) corresponding respectively to the parts of the LCD panel 31, so that the light emission of LEDs is controlled on an area-by-area basis.

Back in FIG. 1, according to the LCD data fed from the area drive circuit 2, the LCD controller 32 generates a signal for driving the LCD driver 33, and feeds it to the LCD driver 33. According to the signal received from the LCD controller 32, the LCD driver 33 switches the states of the individual switching elements on the LCD panel 31.

Thus, according to the image data, the voltage at each pixel electrode in the LCD panel 31 is adjusted, and thereby the degree of transmission of light at each pixel is adjusted. While the LCD panel 31 is illuminated with backlight from behind (backlight is supplied to the LCD panel 31), the image display device 9 displays an image in the display region of the LCD panel 31.

The LED controller 4 includes an adjustment circuit 41, a power calculation circuit 42, a power limiter circuit 43, a PWM signal generation circuit 44, a limit value updating circuit 45, etc. The adjustment circuit 41 applies different kinds of adjustment, such as white balance adjustment and temperature compensation, to the LED data received from the area drive circuit 2.

Based on the adjusted LED data, the power calculation circuit 42 calculates the light emission electric power for each area, and calculates the sum (hereinafter referred to also as the "total light emission electric power") of the light emission electric powers for all areas. The power limiter circuit 43 has a power limit value set (stored) updatably in it, and limits the light emission electric power in each area such that the total light emission electric power does not exceeds the power limit value. Information on the thus limited area-by-area light emission electric powers is fed to the PWM signal generation circuit 44.

Each LED provided in the backlight unit 5 is controlled by a PWM signal fed from the LED controller 4. There is approximately a proportional relationship (correlation) between the electric power consumption by each LED and the PWM value (duty factor) of the corresponding PWM signal. Accordingly, in the embodiment under discussion, based on the PWM generation data, each process that calculates electric power yields it in terms of a PWM value (%).

According to the information on the area-by-area light emission electric powers received from the power limiter circuit 43, the PWM signal generation circuit 44 generates PWM signals containing information on area-by-area PWM values, and feed them to the backlight unit 5.

Based on information on detection by the sensor set 6, the limit value updating circuit 45 updates, as necessary, a power limit value Plimit (which will be described in detail later) set in the power limiter circuit 43. The LED controller 4 further has the function of generating and feeding to an LED driver 21 a driver control signal for controlling an LED driver 51 provided in the backlight unit 5. How the LED controller 4 operates will be described in detail later.

The backlight unit 5 includes an LED driver 51, LEDs 52, an LED mounting board (LED panel) 53, etc. as well as different optical members (not shown), such as a diffuser plate and an optical sheet, that are necessary to produce backlight, and functions as a backlight for the liquid crystal display device. The LED driver 51 has one or more control channels to which the LEDs 52 are connected. According to the PWM signals fed from the LED controller 4, the LED driver 51 drives the LEDs 52 connected to those control channels.

Specifically, in a period in which a PWM signal is at H level, the LED driver 51 supplies predetermined light emission electric power to the LED 52 in the area corresponding to that PWM signal to turn the LED 52 on. By contrast, in a period in which a PWM signal is at L level, the LED driver 51 ceases to supply emission power to the LED 52 in the area corresponding to that PWM signal to turn the LED 52 off.

The LEDs 52 are connected to different control channels at least on an area-by-area basis. Thus, the LEDs 52 can be turned on and off on an area-by-area basis.

The LEDs 52 are formed, for example, as LED chips, and are mounted on the mounting face of the LED mounting board 53 to function as a light source of backlight for the LCD panel 31. The LED mounting board 53 is fitted behind the LCD panel 31 with the mounting face of the LED mounting board 53 facing the LCD panel 31.

Figure 3:
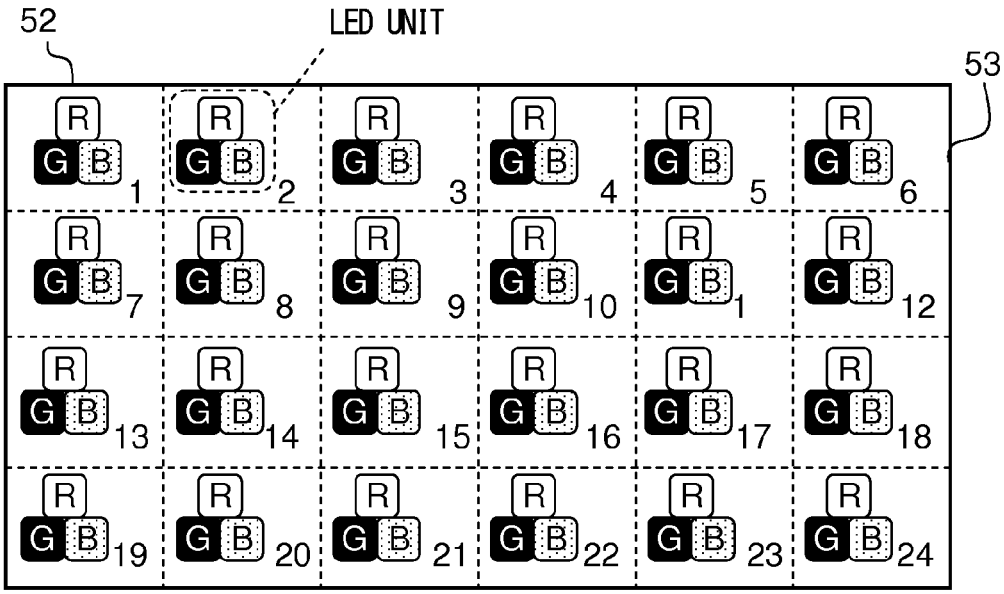
FIG. 3 is a diagram illustrating areas set on an LED mounting board.

As mentioned previously, the LED mounting board 53 is divided, as shown in FIG. 3, into 24 areas corresponding respectively to the parts of the LCD panel 31. In FIG. 3, a number n indicates that the area in which it is marked is the n-th area. The n-th area on the LED mounting board 53 corresponds to the n-th part on the LCD panel 31.

The LEDs 52 are grouped into LED units each including LEDs emitting R, G, and B (red, green, and blue) light, and at least one such LED unit is arranged in each area on the LED mounting board 53. Each LED unit emits substantially white light by emitting R, G, and B light simultaneously. The LEDs 52 may be designed (in terms of their type, color, and combination) in any other manner. For example, instead of LED units as mentioned above, white LEDs may be used, or LED units each including LEDs emitting R, G, B, and W (red, green, blue, and white) light may be used.

The n-th area on the LED mounting board 53 is located approximately right behind the n-th part on the LCD panel 31. Thus, the light emission intensity of the LED unit in the n-th area (in other words, the light emission electric power supplied there) greatly affects the brightness of image display in the n-th part.

The sensor set 6 includes different sensors for detecting environmental conditions around the image display device 9, specifically a temperature sensor 61, a illuminance sensor 62, and a human presence sensor 63. The temperature sensor 61 has, for example, a thermistor or a thermocouple, and detects the temperature of the image display device 9 itself or the temperature around it (the temperature in the place where it is used). Typically, and preferably, the temperature sensor 61 is fitted on the LED mounting board 53 so as to detect the temperature of the LED mounting board 53.

The illuminance sensor 62 has, for example, a photodiode, and detects the illuminance around the image display device 9 (the illuminance in the place where it is used). Preferably, for as proper detection of illuminance as possible, the illuminance sensor 62 is fitted in a top part of the image display device 9 in its normal use (elsewhere than where the sensor is intercepted by the device as in a bottom part thereof).

The human presence sensor 63 has, for example, an ultrasonic sensor or an infrared sensor, or a sensor employing a camera (like one detecting human presence by recognizing a human face in the subjects), and detects the presence (or absence) of a human within a predetermined region (sensing area) around the image display device 9. Information on the results of detection by the different sensors in the sensor set 6 is transferred to the limit value updating circuit 45 on a continuous and real-time basis.

The operation switches 7 are switches (for example, push-button switches) that are operated by a user, and information on how these are being operated is transferred to the limit value updating circuit 45. This permits the limit value updating circuit 45 to operate according to the user's intention.

Configured as described above, the image display device 9 generates LCD data and LED data based on the image data acquired by the image data acquisition section 1 and, by controlling the degree of light transmission through the LCD panel 31 and the luminance of the LEDs 52 (backlight), displays an image. A procedure for controlling the luminance of backlight in the image display device 9 will be described in detail below.

[Procedure for Controlling Luminance of Backlight]

Now, a procedure for controlling the luminance of backlight will be described with reference to a flow chart in FIG. 4.

The image data acquisition section 1 acquires image data, for example, by receiving television broadcast (step S1). The acquired image data is fed to the area drive circuit 2. In response, the area drive circuit 2 generates, based on the image data, LED data for each area (the 1st to 24th areas) (step S2).

In the embodiment under discussion, it is assumed that the PWM value in the LED data for each area is determined based on the maximum value of luminance in the image data corresponding to the area. That is, each part of the LCD panel 31 corresponding to one area includes a plurality of pixels. Thus, it is assumed that, based on the maximum value of luminance among a plurality of pixels, the PWM value in the LED data for a particular area is determined.

The PWM value may be determined by any other method. For example, it may be determined based on the average value of luminance among the plurality of pixels corresponding to each area. In the embodiment under discussion, the determination of the PWM value in the LED data for each area is performed synchronously with the frame period of the acquired image data (that is, on a frame-by-frame basis). This, however, is not meant to limit the period at which the determination of the PWM value is performed. For example, it may instead be performed every five frames, or every 30 frames. In a case where the acquired image data represents still images, the determination of the PWM value may be performed only on transition from one image to the next.

In the processing at step S2, for example, the LED data is generated such that the PWM values for the different areas are as shown in FIG. 5. In FIG. 5, a number n in parentheses indicates that the area in which it is marked is the n-th area. Thus, for example, the PWM value for the 7th area is 100(%). In FIG. 5, the PWM values for the different areas are 0(%), 50(%), or 100(%).

Thereafter, the adjustment circuit 41 in the LED controller 4 receives the LED data from the area drive circuit 2, and applies adjustments such as white balance adjustment and temperature compensation to the LED data (step S3). Thereafter, based on the adjusted LED data, the power calculation circuit 42 calculates the total light emission electric power (step S4).

Figure 4:
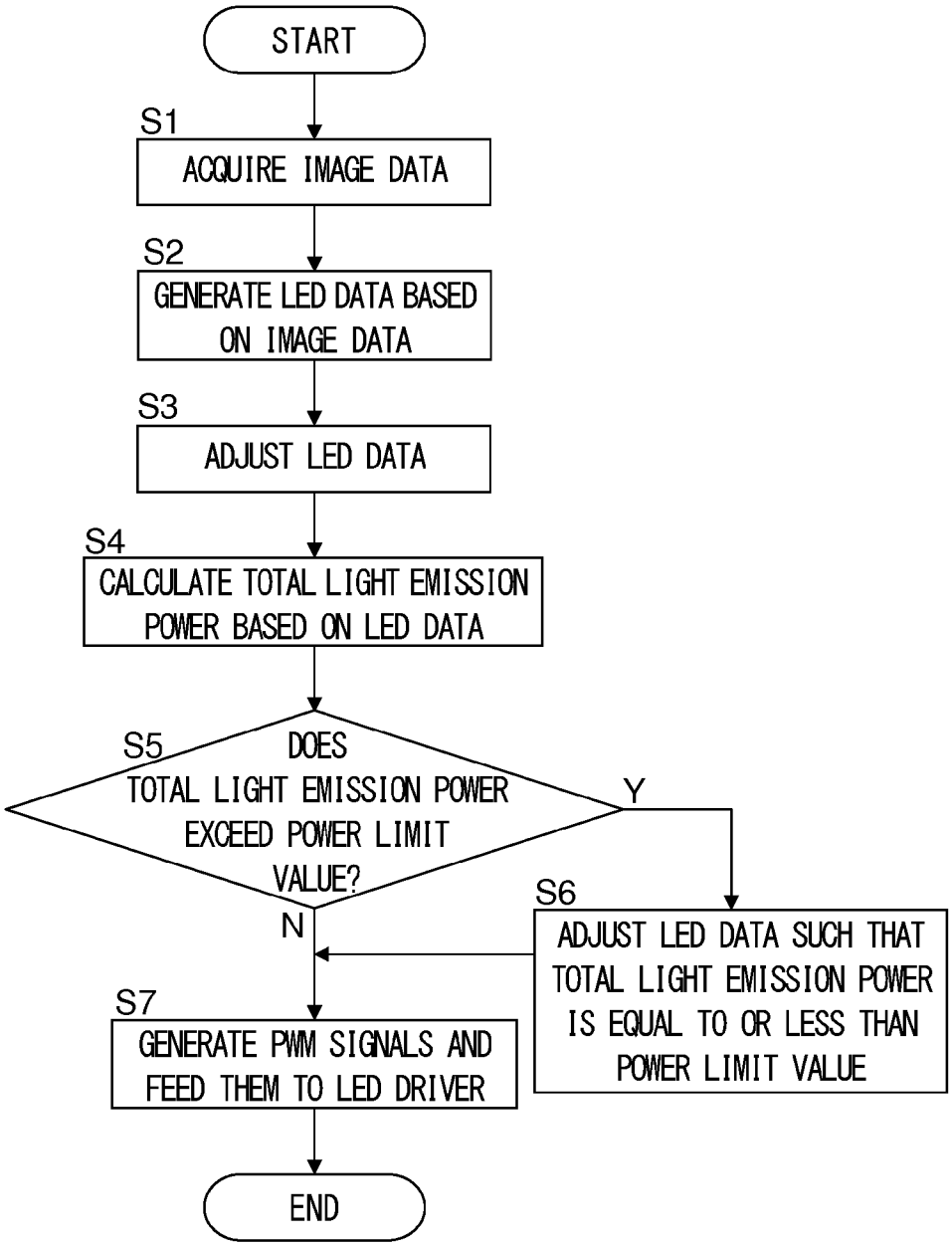
FIG. 4 is a flow chart of a procedure for controlling the luminance of backlight.

In the processing at step S4, for example, in a case where the PWM values in the LED data are as shown in FIG. 4, the total light emission electric power Psum is calculated according to the formula $$\begin{aligned} Psum &= (PWM \text{ Value for 1st Area}) + \\ &\quad (PWM \text{ Value for 2nd Area}) + \ldots + \\ &\quad (PWM \text{ Value for 24th Area}) \\ &= 1600(\%) \text{ (the area average being 66.7\%)} \end{aligned}$$

Next, the power limiter circuit 43 checks whether or not the calculated total light emission electric power Psum exceeds the currently set power limit value Plimit (step S5). If it is found that the limit is not exceeded ("N" at step S5), the power limiter circuit 43 feeds the LED data as it is to the LED controller 4.

If, by contrast, it is found that the limit is exceeded ("Y" at step S5), the power limiter circuit 43 corrects the LED data such that the total light emission electric power Psum is equal to or smaller than the power limit value Plimit (in other words, in such a way that the upper limit of the total light emission electric power Psum is limited at or below the power limit value Plimit) (step S6). The LED data is corrected through the following procedure.

First, the power limiter circuit 43 calculates a limit factor α, which is given by dividing the power limit value Plimit by the total light emission electric power Psum. For example, in a case where the PWM values in the LED data are as shown in FIG. 5 (and hence the total light emission electric power Psum equals 1600(%)) and in addition the power limit value Plimit is set at 1200(%), the limit factor α is calculated as 1200/1600=0.75.

Thereafter, the LCD controller 32 corrects the current LED data by multiplying each PWM value (area-by-area light emission electric power) by the limit factor α. This yields corrected LED data. For example, in a case where the PWM values in the current LED data are as shown in FIG. 5 and in addition the limit factor α equals 0.75, the corrected LED data is generated such that the PWM values for the different areas are as shown in FIG. 6.

Thus, the total light emission electric power Psum according to the corrected LED data is made equal to or smaller than the power limit value Plimit (in the embodiment under discussion, equal to the power limit value Plimit), and in this way the upper limit of the total light emission electric power Psum is limited to the power limit value Plimit. The power limiter circuit 43 feeds the corrected LED data to the PWM signal generation circuit 44.

The PWM values for the different areas in the corrected LED data equal the values given by dividing their respective values before the correction uniformly by the limit factor α. Thus, the ratio among the area-by-area PWM values in the corrected LED data remains equal before and after the correction. In other words, the calculation of the light emission electric powers for the different areas proceeds as follows: first, the ratio among the area-by-area PWM values is determined based on the image data; then the calculation is performed such that the total light emission electric power Psum does not exceed the power limit value Plimit and in addition according to the determined ratio. Consequently, the image display device 9 can, while limiting the total light emission electric power Psum (the electric power consumption by the backlight), maintain image display with a high contrast ratio (with an effect of peak luminance) as much as possible.

Next, according to the LED data received from the power limiter circuit 43 (the PWM values for the different areas included in the LED data), the PWM signal generation circuit 44 generates PWM signals for the different areas and feeds them to the LED driver 51 (step S7). Thus, the light emission electric power supplied to the LED 52 (that is, its light emission state) in each area is controlled by the PWM signal corresponding to that area (that is, PWM-controlled).

The area-by-area PWM control described above may be performed separately for each color (R, G, and B) of the LEDs 52. In that case, the LED data is set separately for each color (R, G, and B) of the LEDs 52 and the different kinds of processing described above are performed.

[Updating of Power Limit Value]

The power limit value Plimit set in the power limiter circuit 43 is updated mainly through the operation of the limit value updating circuit 45. The procedure for updating the power limit value Plimit will now be described in detail.

With predetermined timing, the limit value updating circuit 45 executes an operation (hereinafter referred to as the "updating operation" for convenience's sake) for effecting the updating. This may be done with any timing, for example, every time one or more frames of image data is acquired, or at regular time intervals.

The limit value updating circuit 45 is so configured that, to adapt the electric power consumption of the backlight to the environment in which the image display device 9 is used, the detection results of the different sensors (61 to 63) are reflected in the updated power limit value Plimit. The limit value updating circuit 45 is also so configured as to receive, as to how those detection results are to be reflected, instructions from the user as necessary (for example, at the user's request).

More specifically, the limit value updating circuit 45 is so configured as to accept selections made by the user as to how to set different items in setting information related to electric power (hereinafter referred to as the "power-related setting information"). In the embodiment under discussion, the power-related setting information has items as shown in FIG. 7.

Thus, by operating the operation switches 7, the user can select and set (set on an alternative basis), as to "the detection result of the temperature sensor," whether to "reflect" or "ignore"; as to the detection result of the illuminance sensor, whether to "apply pattern A," "apply pattern B," or "ignore"; as to the detection result of the human presence sensor, whether to "apply pattern C," "apply pattern D," or "ignore."

Figure 7:
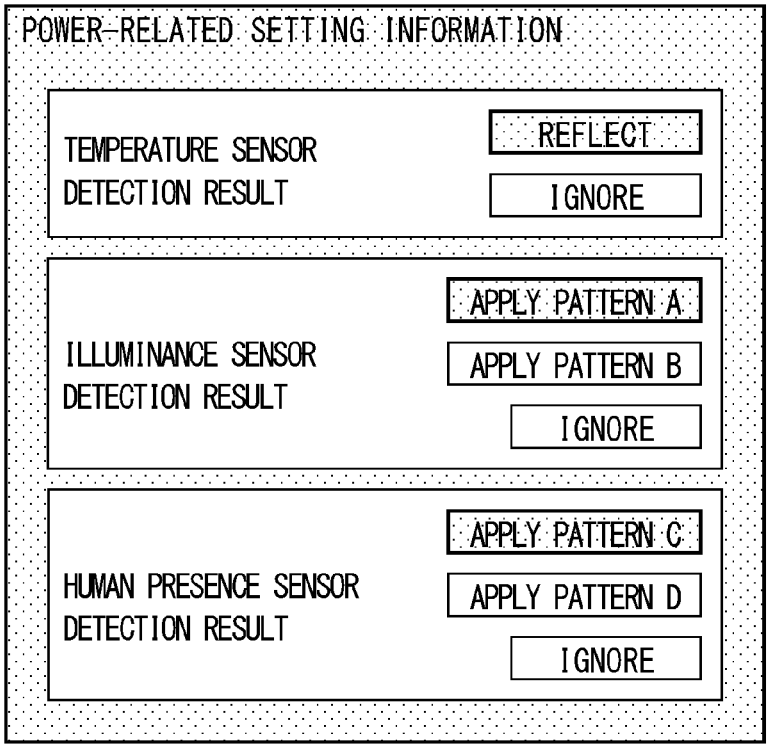
FIG. 7 is a diagram illustrating power-related setting information in the first embodiment.

How to accept selections made by user is not limited to via a screen as specifically shown in FIG. 7 but may be by any other means so long as such selections can be made. The most recent power-related setting information is stored in the limit value updating circuit 45, and is referred to during the execution of the updating operation. How the setting information is used will be clarified later.

Next, how the updating operation proceeds will be described in more detail. First, the limit value updating circuit 45 calculates a new power limit value Plimit according to formula (1) below.

$$Plimit = Pst + P1 + P2 + P3 \quad (1)$$

Here, Pst represents a value previously set as a reference value of the power limit value Plimit P1 represents a parameter commensurate with the detection result of the temperature sensor 61. P2 represents a parameter commensurate with the detection result of the illuminance sensor 62. P3 represents a parameter commensurate with the detection result of the human presence sensor 63.

Pst is set in accordance with the upper limit of the permissible range of the electric power consumption of the backlight in a standard use environment (the predetermined range as prescribed in a standard from the perspectives of power saving and heat reduction). For example, in a case where the state in which the PWM values for all areas on the LED mounting board 53 are 50(%) corresponds to the upper limit of that permissible range, Pst is set at 50(%)×24 (the total number of areas)=1200(%).

Figure 8:
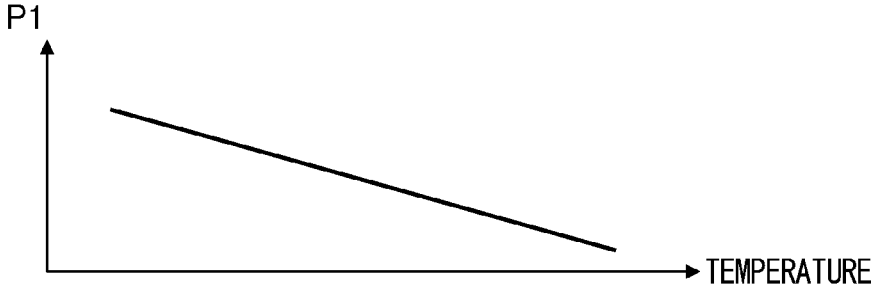
FIG. 8 is a diagram illustrating a procedure for determining parameter P1.

When, in the power-related setting information, the item "the detection result of the temperature sensor" is set for "reflect," parameter P1 is set to be smaller the higher the detection result (the current temperature) of the temperature sensor 61 (for example, according to the graph shown in FIG. 8). Thus, the higher the detected temperature, the smaller the power limit value Plimit is updated to be. However, when the item "the detection result of the temperature sensor" is set for "ignore," parameter P1 is kept at a previously set constant value.

Figure 9:
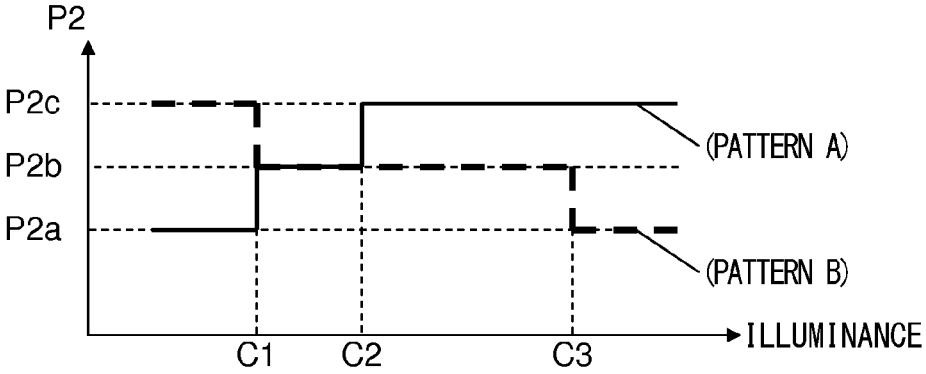
FIG. 9 is a diagram illustrating a procedure for determining parameter P2.

When, in the power-related setting information, the item "the detection result of the illuminance sensor" is set for "apply pattern A," then according to a previously set pattern A, parameter P2 is set to be greater the higher the detection result (current illuminance) of the illuminance sensor 62. For example, according to the graph shown in FIG. 9, when the detection result of the illuminance sensor 62 is higher than a comparatively high value C2 (for example, about 5000 to 10000 lux, provided that the peak luminance in the image display device 9 is 2500 lux), P2 is set at a comparatively great value P2*c*; when the detection result of the illuminance sensor 62 is lower than a comparatively low value C1 (for example, about 0 to 500 lux), P2 is set at P2*a*, which is smaller than P2*c*.

When the detection result of the illuminance sensor 62 is between C1 and C2, P2 is set at P2*b*, which lies between P2*a* and P2*c*. In this way, pattern A is such that, the higher the detected illuminance, the greater the power limit value Plimit is updated to be.

When, in the power-related setting information, the item "the detection result of the illuminance sensor" is set for "apply pattern B," then according to a previously set pattern B, parameter P2 is set to be smaller the higher the detection result of the illuminance sensor 62. For example, according to the graph shown in FIG. 9, when the detection result of the illuminance sensor 62 is higher than an extremely high value C3 (for example, about 100000 lux), P2 is set at P2*a*; when the detection result of the illuminance sensor 62 is lower than C1, P2 is set at P2*c*.

When the detection result of the illuminance sensor 62 is between C1 and C3, P2 is set at P2*b*. In this way, pattern B is such that, the higher the detected illuminance, the smaller the power limit value Plimit is updated to be. When the item "the detection result of the illuminance sensor" is set for "ignore," then, irrespective of the detection result of the illuminance sensor 62, parameter P2 is kept at a constant value (for example, at P2*b*).

When, in the power-related setting information, the item "the detection result of the human presence sensor" is set for "apply pattern C," then parameter P3 is set at a value according to a previously set pattern C. Pattern C is such that parameter P3 is set to be greater (the power limit value Plimit is updated to be greater) when human presence is detected than when not.

By contrast, when the item "the detection result of the human presence sensor" is set for "apply pattern D," then parameter P3 is set at a value according to a previously set pattern D. Pattern D is such that parameter P3 is set to be smaller (the power limit value Plimit is updated to be smaller) when human presence is detected than when not. When the item "the detection result of the human presence sensor" is set for "ignore," then, irrespective of the detection result of the human presence sensor 63, parameter P3 is kept at a previously set constant value.

The limit value updating circuit 45 sets the parameters (P1 to P3), then calculates the power limit value Plimit according to formula (1), and then feeds information on the calculated power limit value Plimit to the power limiter circuit 43. In this way, the power limit value Plimit set in the power limiter circuit 43 is updated with the one newly received from the limit value updating circuit 45. The set power limit value Plimit thus updated is thereafter maintained until the updating takes place next time.

Patterns A and B described above are an example of patterns that represent the relationship between the detected illuminance and parameter P2, and a variety of patterns can be adopted as such patterns. Patterns C and D described above are an example of patterns that represent the relationship between the detection result of the human presence sensor 63 and parameter P3, and a variety of patterns can be adopted as such patterns.

As will be clear from formula (1), the greater any of the parameters (P1 to P3) is, the greater the power limit value Plimit is, and hence the looser the limit on the electric power consumption of the backlight is. That is, the greater any of the parameters (P1 to P3) is, the brighter the backlight is made, and thus the higher the brightness of the displayed image can be made. Accordingly, the setting of the different items in the power-related setting information is done largely in the manner described below.

Generally, when the temperature of (inside the housing of) the image display device 9 is comparatively high, it is preferable to give priority to suppressing a rise in the temperature of the device (to reduce the power limit value Plimit); by contrast, when the temperature is comparatively low, it is preferable to give priority to image viewability (to increase the power limit value Plimit).

Accordingly, in a case where the light emission electric power of the backlight is to be controlled in a way that meets such requirements, the item "the detection result of the temperature sensor" is set for "reflect." On the other hand, in a case where, for some reason or other, the detected temperature should not be reflected in the control of the light emission electric power of the backlight, the item the "detection result of the temperature sensor" is set for "ignore."

According to one principle associated with illuminance, when the ambient illuminance is comparatively high, to prevent the image from becoming hard to view (to prevent the display luminance from being surpassed by the ambient illuminance, it is preferable to give priority to image viewability (to increase the power limit value Plimit); when the ambient illuminance is comparatively low, it is preferable to give priority to saving power (to reduce the power limit value Plimit).

Accordingly, in a case where the light emission electric power of the backlight is to be controlled according to such a principle, the item "the detection result of the illuminance sensor" is set for "apply pattern A."

According to another principle, when the ambient illuminance is extremely high (such that, even with the highest luminance of the backlight, the image is still hard to view (the display luminance is surpassed by the ambient illuminance)), it is preferable to give up displaying an optimized image and give priority to saving power (to reduce the power limit value Plimit); by contrast, when the ambient illuminance is comparatively low, it is preferable to further improve image viewability (increase the power limit value Plimit).

Accordingly, in a case where the light emission electric power of the backlight is to be controlled according to such a principle, the item "the detection result of the illuminance sensor" is set for "apply pattern B." By contrast, in a case where, for some reason or other, the detected temperature should not be reflected in the control of the light emission electric power of the backlight, the item "the detection result of the temperature sensor" is set for "ignore." On the other hand, in a case where, for some reason or other, the detected illuminance should not be reflected in the control of the light emission electric power of the backlight, the item "the detection result of the illuminance sensor" is set for "ignore."

According to one principle associated with human presence, when a human is present nearby, it is preferable to assume him or her to view the image and give priority to image viewability (to increase the power limit value Plimit); when no human is present nearby, it is preferable to give priority to power saving (to reduce the power limit value Plimit).

Accordingly, in a case where the light emission electric power of the backlight is to be controlled according to such a principle, the item "the detection result of the human presence sensor" is set for "apply pattern C."

According to another principle, when no human is present nearby, for example, to enable a human present at a distance to easily recognize where the image display device 9 is, it is preferable to make the image display device 9 to shine brightly (to increase the power limit value Plimit); when a human is present nearby, it is preferable to prevent glare (to reduce the power limit value Plimit).

Accordingly, in a case where the light emission electric power of the backlight is to be controlled according to such a principle, the item "the detection result of the human presence sensor" is set for "apply pattern D." On the other hand, in a case where, for some reason or other, the detection result of the human presence sensor 63 should not be reflected in the control of the light emission electric power of the backlight, the item "the detection result of the human presence sensor" is set for "ignore."

(2) Second Embodiment

[Configuration and Other Features of Image Display Device]

Next, a second embodiment of the invention will be described. An image display device according to the second embodiment is basically similar to one according to the first embodiment except that a clock section 46 is provided instead of the sensor set 6 and that the calculation of the power limit value Plimit proceeds differently. Accordingly, no overlapping description will be repeated unless necessary.

Figure 10:
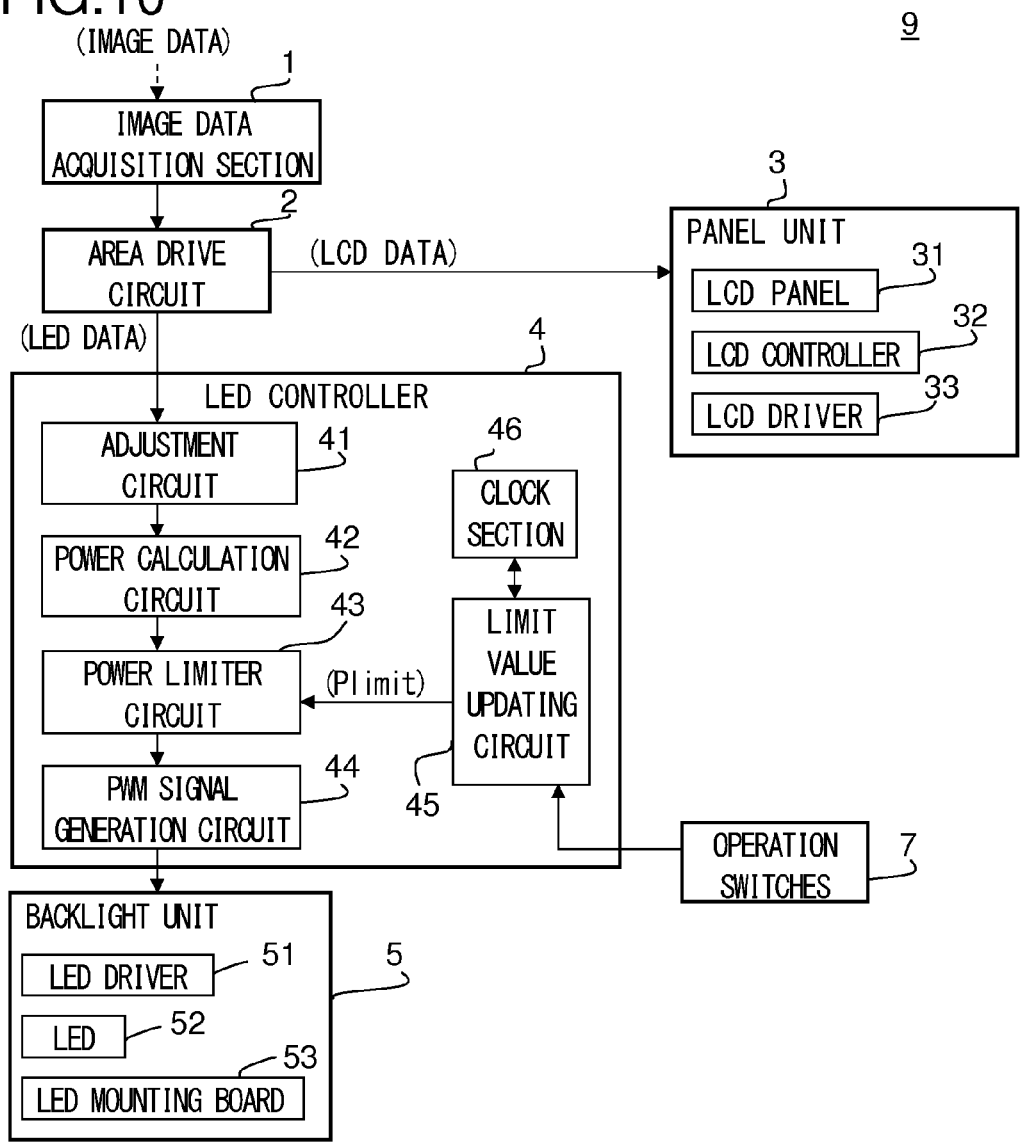
FIG. 10 is a configuration diagram of an image display device according to a second embodiment of the invention.

FIG. 10 is a configuration diagram of an image display device according to the second embodiment. As shown there, the image display device 9 here includes a clock section 46 instead of the sensor set 6 provided in the first embodiment. The clock section 46 includes, for example, a crystal oscillator, and has the function of counting the current time. Information on the current time obtained by the clock section 46 is continuously transferred to the limit value updating circuit 45.

[Updating of Power Limit Value]

In this embodiment, through the updating operation, a new power limit value Plimit is determined according to what time zone the current time belongs to, and with the thus determined value, the power limit value Plimit set in the power limiter circuit 43 is updated. More specifically, the operation proceeds as described below.

With predetermined timing, the limit value updating circuit 45 executes the updating operation. This may be done with any timing, for example, every time one or more frames of image data is acquired, or at regular time intervals.

Figure 11:
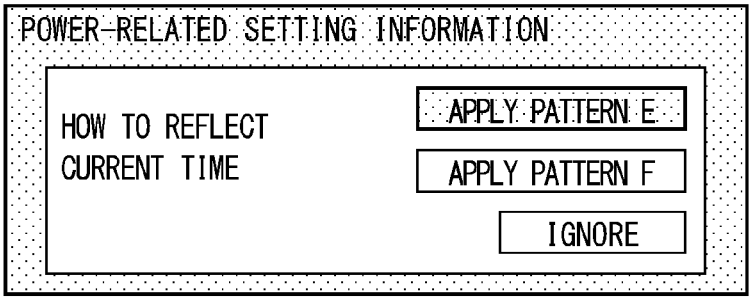
FIG. 11 is a diagram illustrating power-related setting information in the second embodiment.

The limit value updating circuit 45 is so configured as to accept, as the power-related setting information, a selection made by the user as to how to set setting information as shown in FIG. 11. Thus, by operating the operation switches 7, the user can select and set (set on an alternative basis), as to how the current time is to be reflected, whether to "apply pattern E," "apply pattern F," or "ignore."

How to accept the selection made by the user is not limited to via a screen as specifically shown in FIG. 11 but may be by any other means so long as such a selection can be made. The most recent power-related setting information is stored in the limit value updating circuit 45, and is referred to during the execution of the updating operation. How the setting information is used will be clarified later.

Next, how the updating operation proceeds will be described in more detail. First, the limit value updating circuit 45 calculates a new power limit value Plimit according to formula (2) below.

$$Plimit=Pst+P4 \quad (2)$$

Here, Pst represents a value previously set as a reference value of the power limit value Plimit, and is similarly intended as in first embodiment. P4 is a parameter commensurate with the result of the counting of the current time by the clock section 46.

When the power-related setting information is set for "apply pattern E," parameter P4 is determined according to a previously set pattern E. Pattern E is such that, when the current time belongs to a time zone of daytime (for example, a time zone from 6.00 am to 6.00 pm), P4 is set at P4*b* and, when the current time does not belong to that time zone, P4 is set at P4*a*, which is smaller than P4*b*.

By contrast, when the power-related setting information is set for "apply pattern F," parameter P4 is determined according to a previously set pattern F. Pattern F is such that, when the current time belongs to a time zone in which the image display device 9 is supposed to be used comparatively frequently (for example, a time zone from 9.00 am to 5.00 pm, in which there is much traffic of people), P4 is set at P4*b* and, when the current time does not belong to that time zone, P4 is set at P4*a*. On the other hand, when the power-related setting information is set for "ignore," irrespective of the current time, parameter P4 is kept at a previously set constant value.

The limit value updating circuit 45 sets parameter P4, then calculates the power limit value Plimit according to formula (2) noted above, and then feeds information on the calculated power limit value Plimit to the power limiter circuit 43. In this way, the power limit value Plimit set in the power limiter circuit 43 is updated with the one newly received from the limit value updating circuit 45.

The set power limit value Plimit thus updated is thereafter maintained until the updating takes place next time. Patterns E and F described above are an example of patterns that represent the relationship between the time zone and parameter P4, and a variety of patterns can be adopted as such patterns.

As will be clear from formula (2), the greater parameter P4 is, the greater the power limit value Plimit is, and hence the looser the limit on the electric power consumption of the backlight is. That is, the greater parameter P4 is, the brighter the backlight is made, and thus the higher the brightness of the displayed image can be made. Accordingly, the setting of the power-related setting information is done largely in the manner described below.

According to one principle, in a time zone of daytime (a time zone in which it is supposed to be light around), to prevent the image from being hard to view (to prevent the display luminance from being surpassed by the ambient illuminance), it is preferable to give priority to image viewability (to increase the power limit value Plimit); in the other time zone (a time zone in which it is supposed to be dark around), it is preferable to give priority to power saving (to reduce the power limit value Plimit).

Accordingly, in a case where the light emission electric power of the backlight is to be controlled according to such a principle, the power-related setting information is set for "apply pattern E."

According to another principle, in a time zone in which the image display device 9 is supposed to be used comparatively frequently, it is preferable to give priority to image viewability (to increase the power limit value Plimit); in the other time zone, it is preferable to give priority to power saving (to reduce the power limit value Plimit).

Accordingly, in a case where the light emission electric power of the backlight is to be controlled according to such a principle, the power-related setting information is set for "apply pattern F." On the other hand, in a case where, for some reason or other, the current time should not be reflected in the control of the light emission electric power of the backlight, the power-related setting information is set for "ignore."

(3) Third Embodiment

[Configuration and Other Features of Image Display Device]

Next, a third embodiment of the invention will be described. An image display device according to the third embodiment is basically similar to one according to the first embodiment except that, instead of the sensor set 6 being provided, the limit value updating circuit 45 is fed with APL (average picture level) data, and that the calculation of the power limit value Plimit proceeds differently. Accordingly, no overlapping description will be repeated unless necessary.

Figure 12:
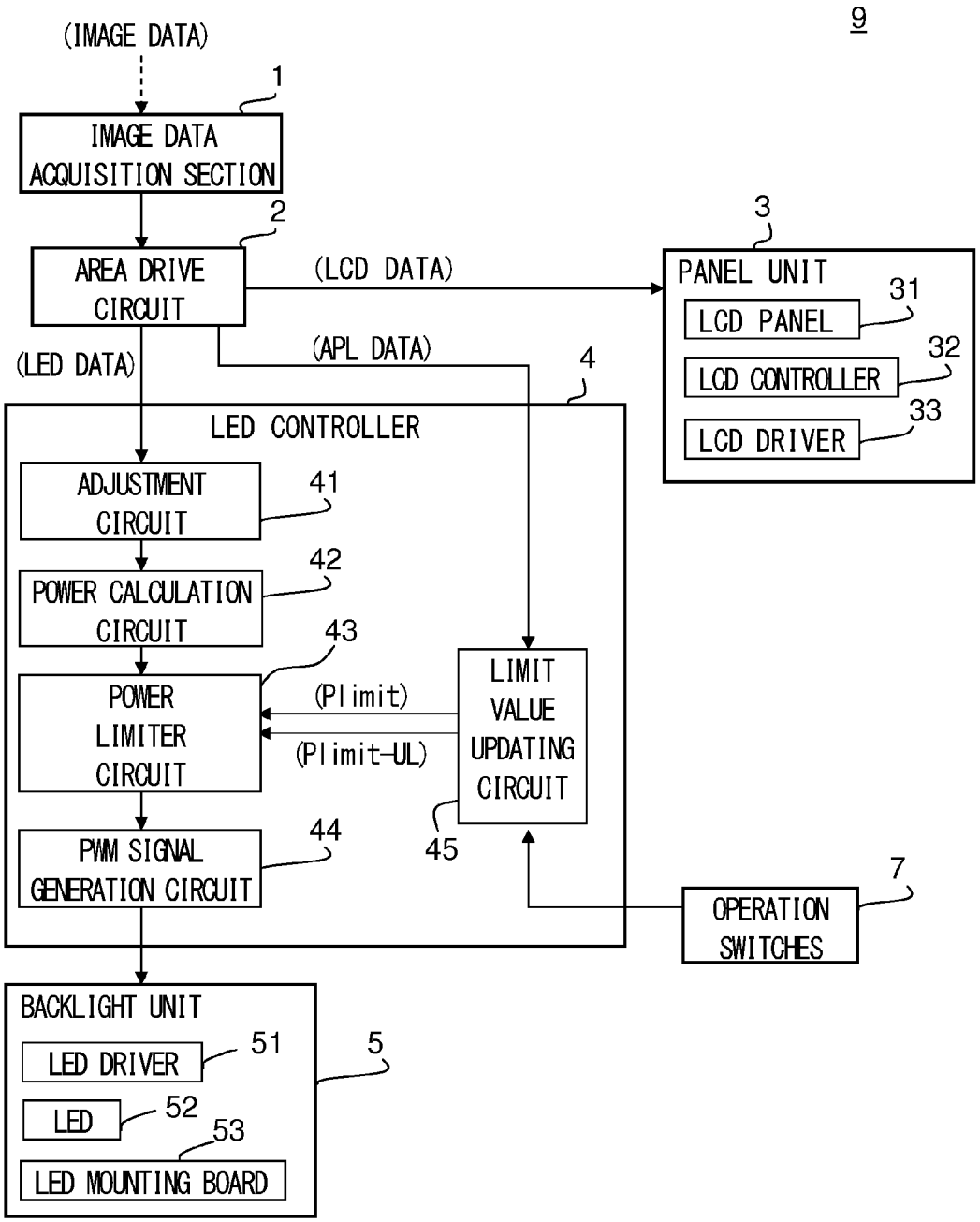
FIG. 12 is a configuration diagram of an image display device according to a third embodiment of the invention.

FIG. 12 is a configuration diagram of an image display device according to the third embodiment. As shown there, the image display device 9 here is, instead of being provided with the sensor set 6 provided in the first embodiment, configured so that APL data is transferred from the area drive circuit 2 to the limit value updating circuit 45. It is moreover so configured that, in addition to information on the power limit value Plimit, information on a peak luminance limit value Plimit-UL (which will be described in detail later) is fed from the limit value updating circuit 45 to the power limiter circuit 43.

Based on the image data received from image data acquisition section 1, the area drive circuit 2 generates not only LED data and LCD data but also APL data. The APL data is data that represents the average image luminance (APL) of each frame of the image data. Each time the area drive circuit 2 receives one or more frames of the image data, the area drive circuit 2 generates APL data with respect to the frame at that moment and feeds it to the limit value updating circuit 45.

The power limiter circuit 43 is so configured as to have, in addition to the power limit value Plimit, a peak luminance limit value Plimit-UL set (stored) updatably in it. The power limiter circuit 43 limits the area-by-area light emission electric powers such that the total light emission electric power Psum does not exceed the power limit value Plimit and in addition that the peak luminance of the LEDs 52 (the maximum luminance value for each LED 52) is limited at or below the peak luminance limit value Plimit-UL. Information on the thus limited area-by-area light emission electric powers is fed to the PWM signal generation circuit 44.

There is approximately a proportional relationship (correlation) between the luminance of an LED 52 and the PWM value (duty factor) of a PWM signal. Accordingly, the luminance of the LEDs 52 and the peak luminance limit value Plimit-UL are given in terms of PWM value (%). Specifically, for example, in a case where the peak luminance limit value Plimit-UL is set at 80(%), the maximum value of the PWM value of each LED 52 is limited to 80(%).

[Updating of Power Limit Value and Peak Luminance Limit Value]

In the embodiment under discussion, the limit value updating circuit 45 performs the updating operation by updating the power limit value Plimit and the peak luminance limit value Plimit-UL set in the power limiter circuit 43 according to the APL data. More specifically, the updating operation proceeds as described below.

Figure 13:
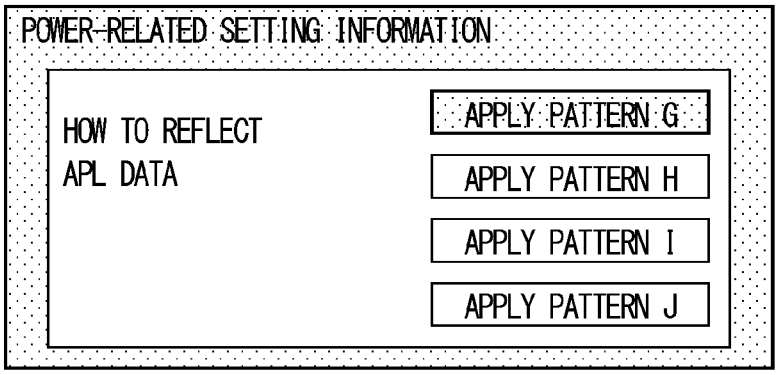
FIG. 13 is a diagram illustrating power-related setting information in the third embodiment.

Each time the limit value updating circuit 45 receives the APL data from the area drive circuit 2, the limit value updating circuit 45 executes the updating operation. The limit value updating circuit 45 is so configured as to accept, as power-related setting information, selections made by the user as to how to set setting information as shown in FIG. 13. Thus, by operating the operation switches 7, the user can select and set (set on an alternative basis), as to how the APL data is to be reflected, whether to "apply pattern G," "apply pattern H," "apply pattern I," or "apply pattern J."

How to accept the selection made by the user is not limited to via a screen as specifically shown in FIG. 13 but may be by any other means so long as such a selection can be made. The most recent power-related setting information is stored in the limit value updating circuit 45, and is referred to during the execution of the updating operation. How the setting information is used will be clarified later.

Figure 14:
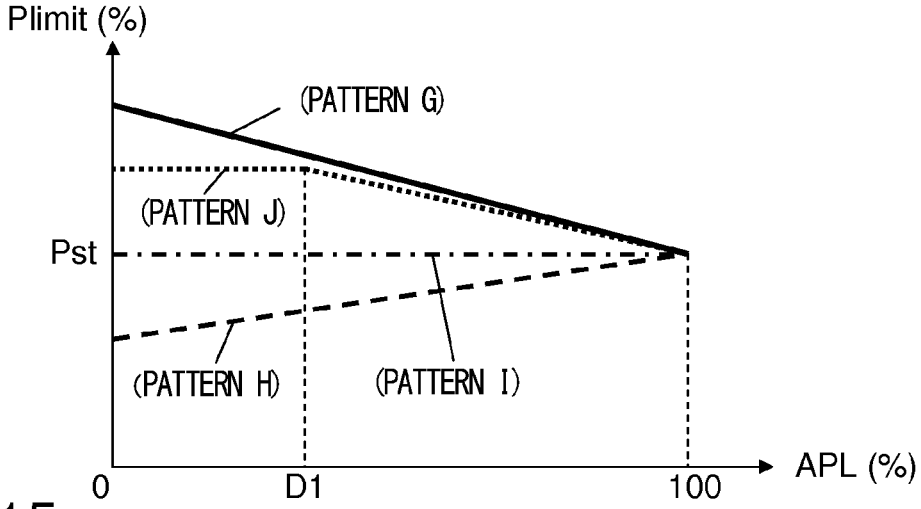
FIG. 14 is a diagram illustrating a relationship between an APL value and a power limit value.

When the power-related setting information is set for "apply pattern G," then the limit value updating circuit 45 determines the power limit value Plimit according to a previously set pattern G. As indicated by a solid line in FIG. 14, pattern G is such that, the smaller the value of the APL data, the greater the power limit value Plimit is made.

When the power-related setting information is set for "apply pattern H," then the limit value updating circuit 45 determines the power limit value Plimit according to a previously set pattern H. As indicated by a broken line in FIG. 14, pattern H is such that, the smaller the value of the APL data, the smaller the power limit value Plimit is made.

When the power-related setting information is set for "apply pattern I," then the limit value updating circuit 45 determines the power limit value Plimit according to a previously set pattern I. As indicated by a broken line in FIG. 14, pattern I is such that, irrespective of the value of the APL data, the power limit value Plimit is kept constant at a predetermined value Pst.

That is, pattern I is such that the APL data is not reflected in the power limit value Plimit. When the power-related setting information is set for "apply pattern G," "apply pattern H," or "apply pattern I," the peak luminance limit value Plimit-UL is set at 100% (that is, the peak luminance has no particular limit).

When the power-related setting information is set for "apply pattern J," then the limit value updating circuit 45 determines the power limit value Plimit according to a previously set pattern J. As indicated by a dotted line in FIG. 14, pattern J is such that, the smaller the value of the APL data, the greater the power limit value Plimit is made.

When the power-related setting information is set for "apply pattern J," and in addition the value of the APL data is greater than a predetermined value D1% (for example 40%), the limit value updating circuit 45 sets the peak luminance limit value Plimit-UL at 100% (that is, the peak luminance has no particular limit); when the value of the APL data is equal to or smaller than D1, by contrast, the limit value updating circuit 45 sets the peak luminance limit value Plimit-UL at a predetermined value X % (for example, 80%).

As described above, the limit value updating circuit 45 sets the power limit value Plimit and the peak luminance limit value Plimit-UL based on the power-related setting information and the APL data, and feeds information on the set values to the power limiter circuit 43. In this way, the power limit value Plimit and the peak luminance limit value Plimit-UL set in the power limiter circuit 43 are updated with those newly received from the limit value updating circuit 45. The set power limit value Plimit and peak luminance limit value Plimit-UL thus updated are thereafter maintained until the updating takes place next time.

Figure 15:
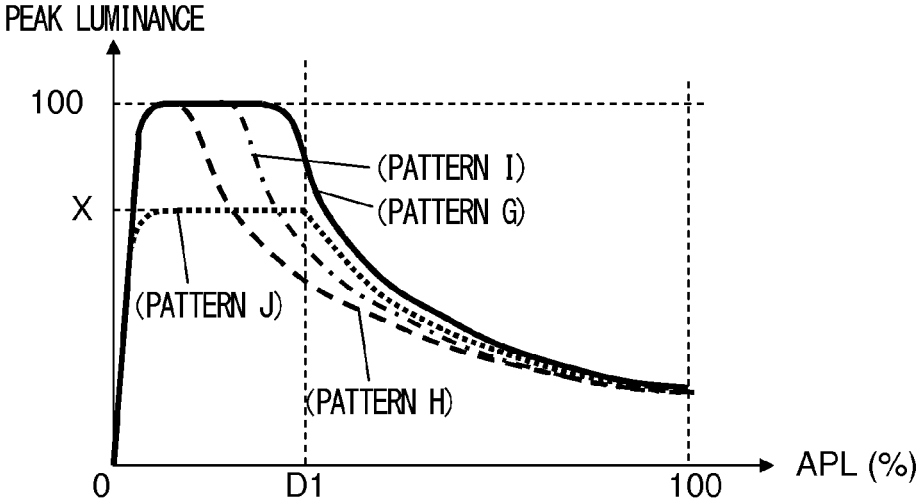
FIG. 15 is a diagram illustrating a relationship between an APL value and peak luminance.

An example of graphs, one for each of patterns G to J for the power-related setting information, representing the relationship between the APL data and the peak luminance is shown in FIG. 15. As shown there, depending on which of patterns G to J is applied, the position of the peak luminance (the value of the APL data when the peak luminance has a certain value) and the height of the peak luminance (the maximum value of the peak luminance) vary.

The height of the peak luminance directly reflects the set peak luminance limit value Plimit-UL. From the perspective of the luminance and electric power consumption of the backlight, the lower the height of the peak luminance is made, the higher priority is given to power saving in the backlight and, the higher the height of the peak luminance is made, the higher priority is given to improved luminance in the backlight.

By selecting one of patterns G to J for the power-related setting information, the user can control the backlight so as to obtain the desired peak luminance position and height. In this way, the image display device 9 permits the peak luminance position and height to be set freely by use of limited electric power.

Patterns G to J described above are an example of patterns that represent the relationship between the APL data and the power limit value Plimit, and a variety of patterns can be adopted as such patterns. Each pattern may be expressed other than in the form of a linear function between the APL data and the power limit value Plimit, and may be defined in the form of a LUT (lookup table).

CONCLUSIONS

In all the embodiments described above, the image display device 9 includes a device (light emitting device for image display) that emits backlight and that has, as main components, an area drive circuit 2, an LED controller 4, and a backlight unit 5. The light emitting device for image display includes a backlight unit 5, which is divided into a plurality of areas and includes LEDs 52 (light emitting elements) corresponding to those areas respectively, and a power calculation section (a functional section composed mainly of a power calculation circuit 42, a power limiter circuit 43, and a limit value updating circuit 45), which calculates, based on image data and on area-by-area basis, the light emission electric power to be supplied to each LED 52, and is so configured as to emit backlight by supplying the light emission electric power to each LED 52 according to the result of the calculation.

The power calculation section performs the calculation such that the sum of the light emission electric powers does not exceed the currently set power limit value Plimit, and includes a limit value updating section (a functional section composed mainly of a sensor set 6 and a limit value updating circuit 45) that updates the power limit value Plimit according to a previously set pattern.

Thus, the light emitting device for image display, despite being of an area-driven type, can limit the light emission electric power supplied to the LEDs 52 flexibly to suit the situation at the moment. In all embodiments, the pattern used in the updating of the power limit value Plimit is set, from the perspectives of power saving and heat reduction, with sufficient attention paid not to supply excessive light emission electric power.

The light emitting device for image display according to the first embodiment includes a sensor set 6 (a temperature sensor 6*a*, an illuminance sensor 6*b*, and a human presence sensor 6*c*), and is so configured as to update the power limit value Plimit, while following the previously set pattern, according to the detection results of the sensor set 6. Thus, it is possible to limit the light emission electric power supplied to the LEDs 52 flexibly to suit the environment at the moment.

In the light emitting device for image display according to the first embodiment, any one or two sensors in the sensor set 6 may be omitted. In that case, from formula (1) noted earlier, whichever parameter (any of P1 to P3) corresponds to an omitted sensor can be excluded.

The light emitting device for image display according to the second embodiment is so configured as to update the power limit value Plimit, while following the previously set pattern, according to whether the current time belongs to a previously set time zone or not. Thus, it is possible to limit the light emission electric power supplied to the LEDs 52 flexibly to suit the time zone at the moment.

Moreover, the light emitting device for image display according to the second embodiment, though provided with none of different sensors for detecting environmental conditions as provided in the first embodiment, is so configured as to be capable of limiting the light emission electric power supplied to the LEDs 52 flexibly to suit the situation at the moment.

The light emitting device for image display according to the third embodiment is so configured as to update the power limit value Plimit, while following the previously set pattern, according to the value of the APL of the image data. Thus, it is possible to limit the light emission electric power supplied to the LEDs 52 flexibly according to the APL of the image data at the moment (the image being displayed on the image display device).

Moreover, in the light emitting device for image display according to the third embodiment, the power calculation section calculates the light emission electric power to be supplied to each LED 52 such that the peak luminance of the LED 52 is limited at or below the currently set power limit value Plimit. The peak luminance limit value Plimit-UL is updated according to the previously set pattern.

Thus, it is possible to limit also the peak luminance of the LEDs 52 flexibly to suit the situation at the moment. This limiting of the peak luminance of the LEDs 52 may be adopted in Embodiments 1 and 2 described above as well.

It should be noted that the embodiments by way of which the present invention has been specifically described above are in no way meant to limit the scope of the invention; in those embodiments, many modifications and variations are possible without departing from the spirit of the invention. Unless inconsistent, any features from any embodiments may be combined together.

INDUSTRIAL APPLICABILITY

The present invention finds applications in a variety of image display devices and the like.

LIST OF REFERENCE SIGNS

1 image data acquisition section
2 area drive circuit
3 panel unit
4 LED controller
5 backlight unit
6 sensor set
7 operation switches
9 image display device
31 LCD panel
32 LCD controller
33 LCD driver
41 adjustment circuit
42 power calculation circuit
43 power limiter circuit
44 PWM signal generation circuit
45 limit value updating circuit
46 clock section
51 LED driver
52 LED (an example of a light emitting element)
53 LED mounting board
61 temperature sensor
62 illuminance sensor
63 human presence sensor

The invention claimed is:

1. A light emitting device for image display, for incorporation in an image display device for display of an image based on image data, the light emitting device comprising:

a light emitter which is divided into a plurality of areas and which includes a plurality of light emitting elements corresponding to the areas respectively;

a power calculator configured to calculate light emission electric powers to be supplied to the light emitting elements respectively based on the image data on an area-by-area basis; and a temperature sensor configured to detect a temperature; wherein the light emitter is configured to emit light used in the display of the image by supplying the light emission electric powers to the light emitting elements respectively according to a result of the calculation;

the power calculator is configured to:

perform the calculation such that a sum of the total light emission electric power does not exceed a power limit value;

update the power limit value according to a result of detection by the temperature sensor; and periodically perform an updating operation to update the power limit value based on the result of detection by the temperature sensor.

2. The light emitting device for image display according to claim 1, wherein the power calculator is configured to update the power limit value according to a value of an APL of the image data.

3. The light emitting device for image display according to claim 2, wherein the power calculator is configured to perform the calculation such that a peak luminance of the light emitting elements is limited at or below a currently set peak luminance limit value; and the power calculator is configured to update the peak luminance limit value according to a previously set pattern.

4. The light emitting device for image display according to claim 3, wherein the limit value updating section is configured to update the peak luminance limit value according to a value of an APL of the image data.

5. The light emitting device for image display according to claim 1, wherein the power calculator is configured to perform the calculation such that a peak luminance of the light emitting elements is limited at or below a currently set peak luminance limit value, and is configured to update the peak luminance limit value according to a previously set pattern.

6. The light emitting device for image display according to claim 5, wherein the power calculator is configured to update the peak luminance limit value according to a value of an APL of the image data.

7. The light emitting device for image display according to claim 1, wherein the power calculator is configured to:

determine, based on the image data, ratios of the light emission electric powers to be supplied for the areas respectively; and perform the calculation such that the sum of the light emission electric powers does not exceed the power limit value and in addition according to the ratios.

8. The light emitting device for image display according to claim 1, wherein the light emitting elements are LEDs.

9. An image display device which displays an image by using light emitted from the light emitting device for image display according to claim 1.

10. An image display device comprising:

a backlight; and an LCD panel of which a degree of light transmission is adjusted on a pixel-by-pixel basis based on the image data; wherein the image display device displays an image in a display region of the LCD panel by supplying light from the backlight to the LCD panel; and the backlight includes the light emitting device for image display according to claim 1.

* * * * *